United States Patent [19]

Karino

[11] Patent Number: 4,572,935

[45] Date of Patent: Feb. 25, 1986

[54] COOKING APPARATUS HAVING AN INITIAL TEMPERATURE SETTING FUNCTION

[75] Inventor: Hisao Karino, Nagoya, Japan

[73] Assignee: Kabushiki Kaisha Toshiba, Kawasaki, Japan

[21] Appl. No.: 702,724

[22] Filed: Feb. 19, 1985

[30] Foreign Application Priority Data

Feb. 21, 1984 [JP] Japan ..... 59-23764[U]
Jul. 12, 1984 [JP] Japan ..... 59-144675

[51] Int. Cl.[4] ..... H05B 6/68

[52] U.S. Cl. ..... 219/10.55 B; 219/10.55 R; 219/492; 219/506; 99/325

[58] Field of Search ..... 219/10.55 B, 10.55 R, 219/10.55 E, 506, 490–494; 99/325, DIG. 14

[56] References Cited

U.S. PATENT DOCUMENTS 4,158,759 6/1979 Mason ..... 219/10.55 B
4,169,222 9/1979 Tucker ..... 219/506 X
4,308,443 12/1981 Tucker et al. ..... 219/506 X
4,309,584 1/1982 Terakami ..... 219/10.55 B
4,343,990 8/1982 Ueda ..... 219/10.55 B X
4,399,352 8/1983 Ueda ..... 219/10.55 B X
4,430,540 2/1984 Scalf ..... 219/10.55 B

FOREIGN PATENT DOCUMENTS 59-18836 5/1984 Japan .

*Primary Examiner*—Philip H. Leung
*Attorney, Agent, or Firm*—Cushman, Darby and Cushman

[57] ABSTRACT

A cooking apparatus comprising a cooking apparatus housing having a heating chamber which allows an oven-cooking mode by the operation of a heater, and a temperature sensor for detecting the temperature inside the heating chamber, a first control section for comparing the temperature in the heating chamber detected by the temperature sensor with a preset cooking temperature, and for controlling the heater in accordance with the comparison results, a first setting unit for setting the cooking temperature in steps in response to the operation of a temperature setting member, a second setting unit for initially setting the cooking temperature at a predetermined value which is frequently used before a setting operation of the first setting unit, and a second control section for controlling the operation time of the first control section in accordance with a preset cooking time.

10 Claims, 16 Drawing Figures

COOKING APPARATUS HAVING AN INITIAL TEMPERATURE SETTING FUNCTION

BACKGROUND OF THE INVENTION

The present invention relates in general to cooking apparatus and, more particularly, to an improved cooking apparatus with an oven-cooking function carried out by means of a heater heating a heating chamber.

In a conventional cooking apparatus of this type such as a microwave oven, in an oven-cooking mode, a heater in a heating chamber is controlled by comparing a preset cooking temperature with the current temperature in the heating chamber detected by a temperature sensor. Temperature setting keys, e.g., temperature-up and temperature-down keys are provided on an operation panel as means for setting a cooking temperature. A cooking temperature is initially set at a lower limit temperature, e.g., 100° C. when either the temperature-up or temperature-down key is operated for the first time. The cooking temperature is increased in steps toward an upper limit temperature, e.g., 250° C. in response to the operation of the temperature-up key. When the temperature-down key is depressed, the cooking temperature is decreased in steps toward the lower limit temperature of 100° C. Note that in this case, the designated cooking temperature is successively displayed on a display unit of the operation panel.

However, in the oven-cooking mode, the cooking temperature is most frequently near 200° C. For this reason, if the cooking temperature is initially set at 100° C., it takes a long time to shift the cooking temperature to a desired value, thus the operation is cumbersome.

In the cooking apparatus of this type, ten keys are not used to set the cooking temperature for the following reasons.

(1) A ten key arrangement is complicated.

(2) If a wrong value is set, ten keys must be again operated after a clear key operation.

(3) The key switch arrangement needs more space. Thus, the space for cooking menu selection keys becomes smaller.

(4) Cooking temperatures usually range from 100° C. to 250° C. It is generally unnecessary to set a temperature outside this range. Further, it is usually uncessary to raise or lower the temperature by 1° C.

SUMMARY OF THE INVENTION

It is, therefore, an object of the present invention to provide a new and improved cooking apparatus in which a desired cooking temperature can be quickly set, thereby providing a more practical apparatus which is easily operated.

According to the present invention, a cooking apparatus comprises:

a cooking apparatus housing having a heating chamber which allows an oven-cooking mode by means of the operation of a heater, and a temperature sensor for detecting a temperature inside the heating chamber; first controlling means for comparing a temperature in the heating chamber detected by the temperature sensor with the preset cooking temperature, and for controlling the heater in accordance with the comparison results; first setting means for setting the cooking temperature in steps in response to the operation of a temperature setting member; second setting means for initially setting the cooking temperature at a predetermined value which is frequently used before the setting operation of the first setting means; and second control means for controlling the operation time of the first control means in accordance with a preset cooking time.

BRIEF DESCRIPTION OF THE DRAWINGS

These and other objects and features of the present invention can be understood by reference to the accompanying drawings, in which.

DETAILED DESCRIPTION OF THE PREFERRED EMBODIMENTS

A common, basic arrangement of cooking apparatuses according to the first and second embodiments of the present invention will be described with reference to the accompanying drawings.

Figure 1:
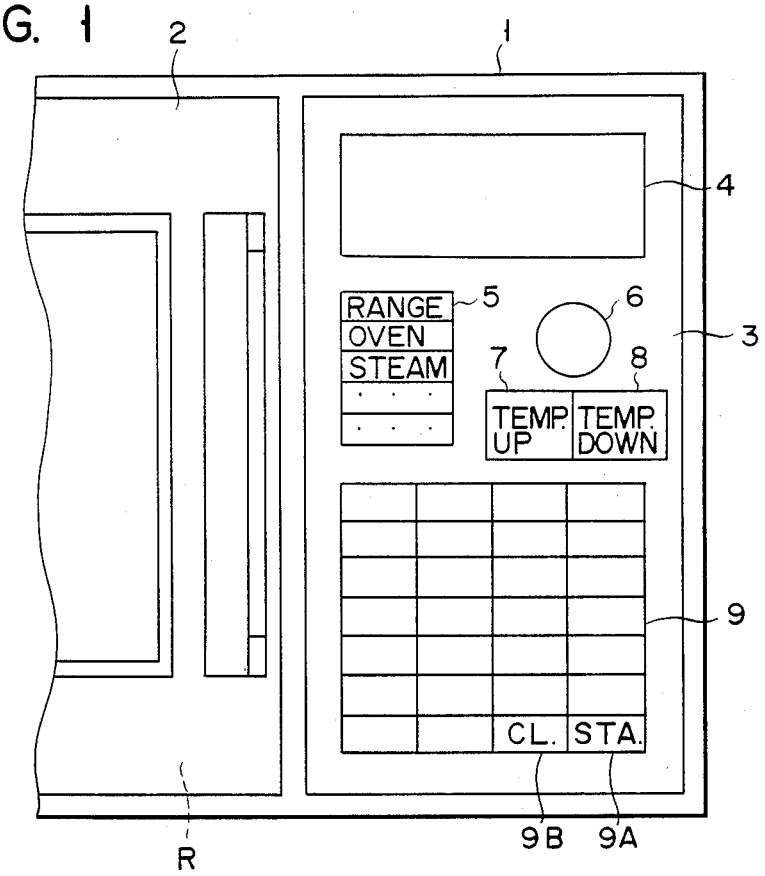
FIG. 1 is a front view showing the main part of a common, basic arrangement of cooking apparatuses according to the first and second embodiments of the present invention.

In a partial front view of FIG. 1, reference numeral 1 denotes the housing of a cooking apparatus, for example, a microwave oven. On one side of the front of the housing 1, a door 2 is pivotally supported to freely open and close a heating chamber R, and an operation panel 3 is provided. A display unit 4, cooking mode selection keys 5, a timer control 6, temperature-up and temperature-down keys 7 and 8 as cooking temperature setting keys, and a plurality of cooking menu selection keys 9, a start key 9A and a clear key 9B are arranged on the operation panel 3 from an upper portion to a lower portion thereof.

Figure 2:
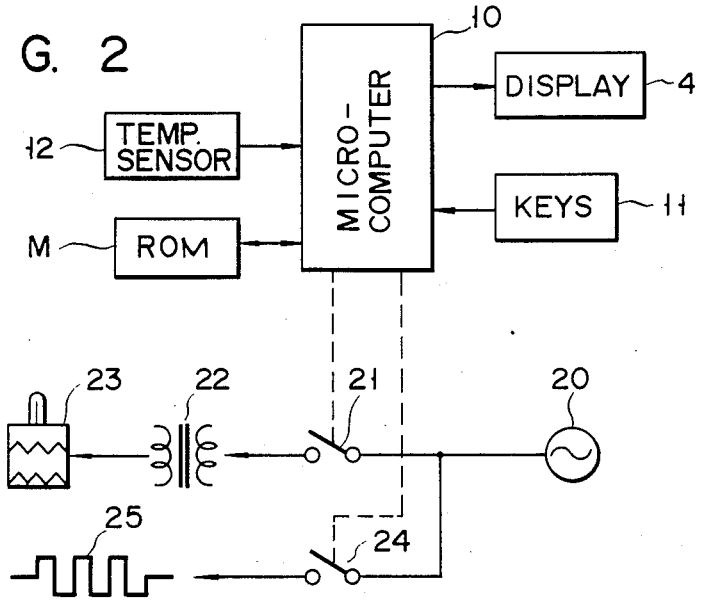
FIG. 2 is a block diagram schematically showing the main part of a control circuit.

FIG. 2 is a block diagram of the main part of a control circuit installed in the housing 1 of the cooking apparatus. Reference numeral 10 denotes a microcomputer as a main control unit. The microcomputer 10 is connected to the display unit 4, an operation group 11 consisting of the various keys 9, 9A, 9B and the timer control 6 on the operation panel 3, a temperature sensor 12 for detecting the temperature inside the heating chamber, and a memory M such as a ROM for storing a program required for operations of the first and second embodiments. Reference numeral 20 denotes a commercial AC power source which is connected to a magnetron 23 as a high frequency generator through a control switch (relay contact) 21 responsive to a command from the microcomputer 10, and a high voltage transformer 22. The magnetron 23 supplies high frequency microwaves to the heating chamber. The power source 20 is also connected to a heater 25 through a control switch (relay contact) 24 responsive to a command from the microcomputer 10. The heater 25 is arranged in the heating chamber.

Figure 3:
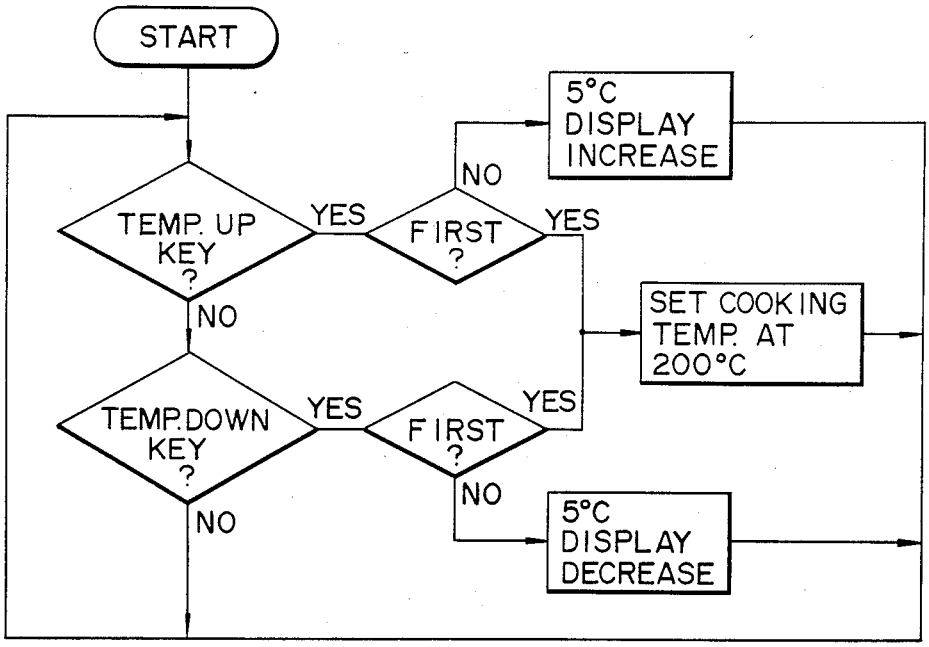
FIG. 3 is a flow chart for explaining an operation of the cooking apparatus according to the first embodiment of the present invention.

With the above arrangement, the operation of the apparatus of the first embodiment will be described with reference to a flow chart shown in FIG. 3.

Figure 4A:
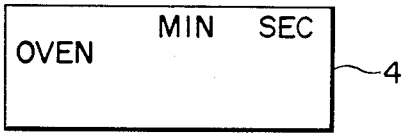
FIGS. 4 (*a*), 4(*b*) and 4(*c*) are representations showing the content of a display unit of the first embodiment.
Figure 4B:
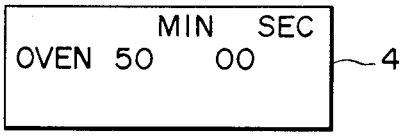
Figure 4C:
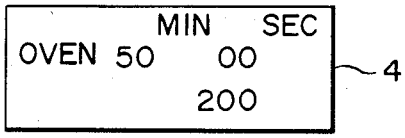

A user opens the door 2, places food to be cooked in a heating chamber R, and closes the door 2. An oven key of the cooking mode selection keys 5 is depressed so as to select the oven-cooking mode. At this time, the microcomputer 10 sets the oven-cooking mode in response to the operation of the oven key and displays characters "OVEN" on the display unit 4, as shown in FIG. 4(*a*). When the user rotates the timer control 6, the microcomputer 10 sets a cooking time in accordance with a rotational angle of the timer control 6 and displays the selected cooking time on the display unit 4, as shown in FIG. 4(*b*). When the user depresses the temperature-up or temperature-down key 7 or 8, the microcomputer 10 first sets a cooking temperature at 200° C. as an initial value and displays it on the display unit 4, as shown in FIG. 4(*c*). The cooking temperature of "200° C." is frequently used in the oven-cooking mode.

When the desired cooking temperature is 200° C., the user need not push the key 7 or 8 again. When it is higher or lower than 200° C., however, he or she must repeatedly push the key until the temperature changes from 200° C. to the desired one. In this case, each time the key 7 or 8 is pushed, the microcomputer 10 raises or lowers the temperature by 5° C., and the display unit 4 displays the changed temperature. Hence, when the desired cooking temperature is 215° C., the user pushes the key 7 three times, thus raising the temperature to 215° C. When it is 185° C., he or she pushes the key 8 three times, thereby lowering the temperature to 185° C. Note the upper and lower temperature limits for cooking are 250° C. and 100° C., respectively.

When either the temperature-up or temperature-down key 7 or 8 is depressed for the first time, the microcomputer initially sets the cooking temperature at 200° C. which is frequently used in the oven-cooking mode. For this reason, time required for setting the desired cooking temperature can be considerably reduced.

When the user operates the start key 9A of the operation panel 3 so as to start cooking, the microcomputer 10 turns on the control switch 24 and operates the heater 25, thereby starting the oven-cooking mode. In the oven-cooking mode, the microcomputer 10 compares the temperature in the heating chamber detected by the temperature sensor 12 with the preset cooking temperature, and performs the ON/OFF control of the control switch 24 in accordance with the comparison result, thereby controlling the operation of the heater 25 so as to maintain the temperature in the heating chamber at the preset cooking temperature. At the same time, the microcomputer 10 counts the time and turns off the control switch 24 when the preset cooking time has elapsed, thereby stopping the operation of the heater 25. In other words, the oven-cooking mode is completed.

Figure 5:
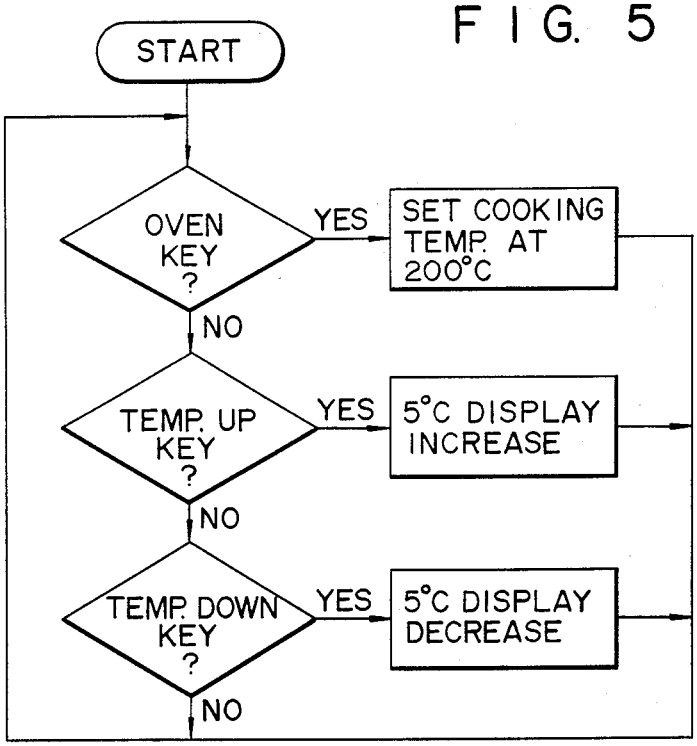
FIG. 5 is a flow chart for explaining the operation of a cooking apparatus which is a modification of the first embodiment.
Figure 6A:
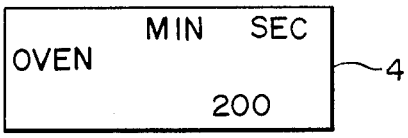
FIGS. 6 (*a*), 6(*b*) and 6(*c*) are representations showing the content of a display unit of the modification.
Figure 6B:
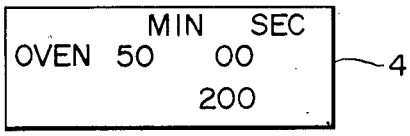
Figure 6C:
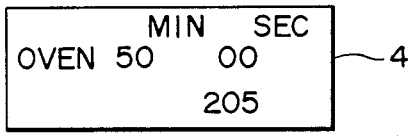

Note that in the first embodiment, the microcomputer 10 sets the cooking temperature at 200° C. when the temperature-up or temperature-down key 7 or 8 is depressed for the first time. However, the cooking temperature can be set at 200° C. when the oven-cooking mode is selected by depressing the oven key. FIGS. 5, 6(*a*), 6(*b*) and 6(*c*) show the processing flow of the microcomputer 10 and the display state of the display unit 4 during this operation. When the oven key of the cooking mode selection keys 5 is depressed, the microcomputer 10 selects the oven-cooking mode and sets the cooking temperature at 200° C. as an initial value. In addition, as shown in FIG. 6(*a*), the microcomputer 10 displays characters "OVEN" and number "200" on the display unit 4. Next, the microcomputer 10 sets the cooking time in accordance with the operation of the timer control 6 and displays it on the display unit 4, as shown in FIG. 6(*b*). When the temperature-up or temperature-down key 7 or 8 are depressed, the microcomputer 10 increases or decreases the cooking temperature in increments or decrements of 5° C. from 200° C., and sequentially displays the temperature, for example, as shown in FIG. 6(*c*).

In the first embodiment, the cooking temperature is initially set at 200° C. However, the present invention is not limited to this, and the initial value can be a frequently used cooking temperature. It is convenient for a user to have an adjustable initial cooking temperature.

Figure 7:
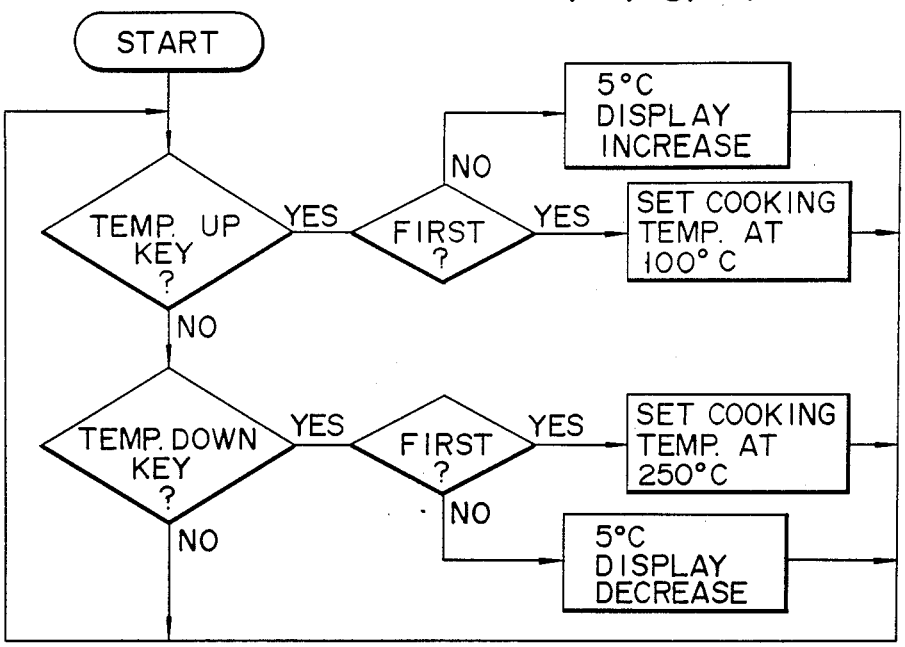
FIG. 7 is a flow chart for explaining the operation of the cooking apparatus according to the second embodiment of the present invention.
Figure 8A:
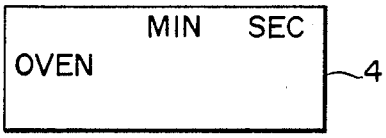
FIGS. 8(*a*), 8(*b*), 8(*c*) and 8(*d*) are representations showing the content of a display unit of the second embodiment.
Figure 8B:
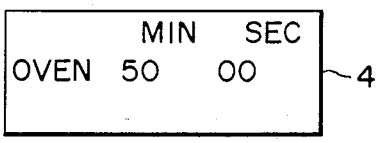
Figure 8C:
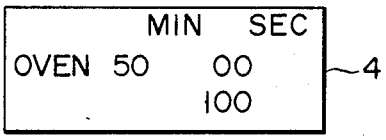
Figure 8D:
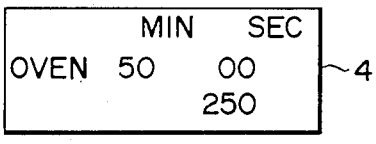

In the above arrangement, an operation according to the second embodiment will be described with reference to a flow chart shown in FIG. 7.

Figure 9:
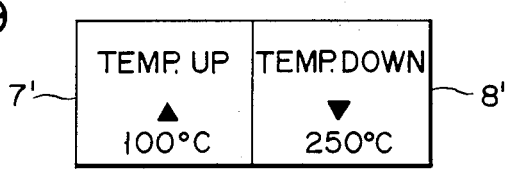
FIG. 9 is a view showing a temperature setting key unit of the second embodiment in detail.

The user opens the door 2, places food to be cooked in the heating chamber R, and closes the door 2. Then, he depresses the oven key of the cooking mode selection keys 5, thereby selecting the oven-cooking mode. At this time, the microcomputer 10 sets the oven-cooking mode in response to the depression of the oven key and displays characters "OVEN" on the display unit 4, as shown in FIG. 8(*a*). When the user rotates the timer control 6, the microcomputer 10 sets the cooking temperature in accordance with the rotational angle thereof and displays the cooking time on the display unit 4, as shown in FIG. 8(*b*). When the user depresses a temperature-up or temperature-down key 7' or 8' which is arranged as shown in FIG. 9 in this embodiment, the microcomputer 10 sets the cooking temperature at the lower limit cooking temperature of 100° C. or the upper limit cooking temperature of 250° C., for example, as an initial value, and displays the temperature on the display unit 4, as shown in FIG. 8(*c*) or 8(*d*).

When the upper limit cooking temperature is set at 250° C., and the desired cooking temperature is 215° C., the user pushes the temperature-down key 7' seven times. Each time the key 7' is depressed, the microcomputer 10 lowers the cooking by 5° C., and the display unit 4 displays the changed temperature. As a result, the temperature is lowered from 250° C. to 215° C. On the other hand, when the lower limit cooking temperature of 100° C. is set, and the desired cooking temperature is 150° C., the user pushes the temperature-up key 8' ten times. Each time the key 8' is pushed, the microcomputer 10 raises the temperature by 5° C., and the unit 4 displays the changed temperature. Hence, the temperature is raised from 100° C. to 150° C.

In this manner, when the temperature-up or temperature-down key 7' or 8' is depressed for the first time, one of the lower and upper limit cooking temperatures of 100° C. and 250° C. is initially set. For this reason, time required for setting the desired cooking temperature is considerably reduced.

When the user operates the start key 9A of the operation panel 3 to start cooking, the microcomputer 10 turns on the control switch 24 and operates the heater 25, thereby starting the oven-cooking mode. In the oven-cooking mode, the microcomputer 10 compares a temperature in the heating chamber detected by the temperature sensor 12 with the preset cooking temperature, and performs ON/OFF control of the control switch 24 in accordance with the comparison results, thereby controlling the operation of the heater 25 so as to maintain the temperature in the heating chamber at the preset cooking temperature. At the same time, the microcomputer 10 counts time and turns off the control switch 24 when the preset cooking time has elapsed, thereby stopping the operation of the heater 25. In other words, the oven-cooking mode is completed.

The cooking time can be controlled by using a mechanical timer switch in place of the microcomputer 10.

It should be noted that the first and second embodiments have been described when keys of a depression type are used. However, the present invention can be applied to an apparatus which uses keys of a touch type.

In the first and second embodiments, the clear key 9B is depressed when the interruption of each operation is desired.

As described above, according to the present invention, a desired cooking temperature can be quickly set, thereby providing a more practical apparatus which is easily operated.

What is claimed is:

1. A cooking apparatus including an arrangement for setting an initial cooking temperature, comprising:

a housing including means for defining a heating chamber which can be operated in an over-cooking mode heated by a heater, and a temperature sensor for detecting the temperature inside said heating chamber;

a temperature-up setting key for increasing the temperature within said heating chamber in steps in response to each key depression thereof;

a temperature-down setting key for decreasing the temperature within said heating chamber in steps in response to each key depression thereof;

a timer control member for setting a cooking time for the cooking performed in said heating chamber;

first control means for receiving timing information when either said temperature-up setting key or said temperature-down setting key is first depressed and for controlling said heater on the basis of the detection values obtained from said sensor, in order to set the temperature within said heating chamber to a predetermined initial cooking temperature;

second control means for receiving depression information representative of the depression of said temperature-up setting key or temperature-down setting key after temperature within said heating chamber is set to the initial cooking temperature, and for controlling said heater on the basic of the detection value obtained from said sensor in order to set a cooking temperature corresponding to daid depression information; and third control means for receiving the timing information set by said timer control member and controlling an operation time of said first or second controlling means.

2. A cooking apparatus according to claim 1, further comprising: display means for successively displaying the initial cooking temperature set by said second control means.

3. A cooking apparatus according to claim 1 wherein the predetermined initial cooking temperature is 200° C.

4. A cooking apparatus including an arrangement for setting an initial cooking temperature, comprising:

a housing having a heating chamber which can be operated in an over-cooking mode heated by a heater, and a temperature sensor for detecting the temperature inside said heating chamber;

a plurality of cooking mode selection members of selecting a desirable one among a plurality of cooking modes including at least the oven-cooking mode;

a temperature-up setting key for increasing the temperature within said heating chamber insteps in response to each key depression thereof;

a temperature-down setting key for decreasing the temperature within said heating chamber in steps in response to each key depression thereof;

a timer control member for setting a cooking time for the cooking performed in said heating chamber;

first control means for receiving timing information when the oven-cooking mode is selected by said cooking mode selection members and for controlling said heater on the basis of the detection values obtained from said sensor, in order to set the temperature within said heating chamber to one of a plurality of possible initial cooking temperatures including 200° C.;

second control means for receiving depression information respresentative of the depression of said temperature-up setting key or temperature-down setting key after the temperature within said heating chamber is set to the initial cooking temperature, and for controlling said heater on the basis of the detection values obtained from said sensor in order to set the cooking temperature to correspond to said depression information; and third control means for receiving time information set by said timer control member and controlling, in response thereto, the operation time of said first or second controlling means.

5. A cooking apparatus according to claim 4, further comprising: display means for successively displaying the initial cooking temperature set by said first control means and the cooking temperature set by said control means.

6. A cooking apparatus including an arrangement for setting an initial cooking temperature, comprising:

a cooking housing having a heating chamber which can be operated in an oven-cooking mode heated by a heater, and a temperature sensor for detecting the temperature inside said heating chamber;

a temperature-up setting key for increasing the temperature within said heating chamber in steps in response to each key depression thereof;

a temperature-down setting key for decreasing the temperature within said heating chamber in steps in response to each key depression thereof;

a timer control member for setting a cooking time for the cooking performed in said heating chamber;

first control means for receiving timing information when said temperature-up setting key is first depressed and for controlling said heater on the basis of the detection values obtained from said sensor, in order to set the temperature within said heating chamber to a first predetermined initial cooking temperature.

second control means for receiving the information on a timing when said temperature-down setting key is first depressed and for controlling said heater on the basis of the detection and for controlling from said sensor, in order to set the temperature within said heating chamber of a second predetermined initial cooking temperature.

third control means for for receiving depression information representative of the depression of said temperature-up setting key or temperature-down setting key after the temperature within said heating chamber is set to an initial cooking temperature, and for controlling said heater on the basis of the detection values obtained fro said sensor, in order to set the cooking temperature to a temperature corresponding to said depression information; and fourth control means for receiving the time information set by said timer control member and controlling the operation time of said first, second or third controlling means.

7. A cooking apparatus according to claim 6, further comprising: display means for successively displaying the initial cooking temperature set by said first and second control means and the cooking temperature set by said third control means.

8. A cooking apparatus according to claim 6 wherein the first predetermined initial cooking temperature is 100° C.

9. A cooking apparatus according to claim 8 wherein the second predetermined initial cooking temperature is 250° C.

10. A cooking apparatus according to claim 6 wherein the second predetermined initial cooking temperature is 250° C.

* * * * *